US009731428B2

(12) United States Patent
Levine et al.

(10) Patent No.: US 9,731,428 B2
(45) Date of Patent: Aug. 15, 2017

(54) FOOD SLICING APPARATUS

(71) Applicant: INSPIRALIZED WORLDWIDE LIMITED LIABILITY COMPANY, Jersey City, NJ (US)

(72) Inventors: Stephen Levine, Far Hills, NJ (US); Alissandra Cerda, Jersey City, NJ (US)

(73) Assignee: INSPIRALIZED WORLDWIDE LIMITED LIABILITY COMPANY, Jersey City, NJ (US)

( * ) Notice: Subject to any disclaimer, the term of this patent is extended or adjusted under 35 U.S.C. 154(b) by 121 days.

(21) Appl. No.: 14/634,375

(22) Filed: Feb. 27, 2015

(65) Prior Publication Data

US 2016/0250768 A1 Sep. 1, 2016

(51) Int. Cl.

| | |
|---|---|
| ***B26D 3/11*** | (2006.01) |
| ***B26D 1/03*** | (2006.01) |
| ***B26D 7/06*** | (2006.01) |
| *B26D 3/28* | (2006.01) |

(52) U.S. Cl.

CPC ..... *B26D 3/11* (2013.01); *B26D 1/03* (2013.01); *B26D 7/0608* (2013.01); *B26D 2003/285* (2013.01); *B26D 2003/287* (2013.01); *B26D 2003/288* (2013.01)

(58) Field of Classification Search

CPC ..... B26D 3/11; B26D 7/0608; B26D 1/03; B26D 2003/288; B26D 2003/285; B26D 2003/287

See application file for complete search history.

(56) References Cited

U.S. PATENT DOCUMENTS

| | | | | | |
|---|---|---|---|---|---|
| 1,875,481 | A | * | 9/1932 | Morante | A47J 43/255 241/277 |
| 2,715,927 | A | * | 8/1955 | Cupper | B26D 3/22 269/54.4 |
| 3,952,621 | A | * | 4/1976 | Chambos | B26D 1/03 83/408 |
| D414,983 | S | * | 10/1999 | Wong | D7/381 |
| 6,053,098 | A | * | 4/2000 | Yamamoto | B26D 3/11 83/425.1 |

(Continued)

FOREIGN PATENT DOCUMENTS

| | | | | |
|---|---|---|---|---|
| EP | 2732744 B1 | | 11/2014 | |
| TW | GB 2313771 A | * | 12/1997 | A47J 43/25 |

OTHER PUBLICATIONS

Inspiralized, Feb. 25, 2015, The Inspiralizer® by Inspiralized, Inspiralized, [online], available from: https://www.youtube.com/watch?v=uqPbCFAhgPc, Accessed Apr. 6, 2016.

(Continued)

*Primary Examiner* — Jonathan Riley
(74) *Attorney, Agent, or Firm* — Klarquist Sparkman, LLP

(57) ABSTRACT

A slicing apparatus and methods of using a slicing apparatus are provided. The apparatus can include a base configured to rest on a horizontal surface, a vertically extending cutting area generally perpendicular to the horizontal surface, and a food carriage for laterally moving and rotating a food item engaged with the food carriage. The cutting area can include blades angled relative to each other, and a multi-blade tool that allows adjustment and selection of different blades.

22 Claims, 6 Drawing Sheets

(56) References Cited

U.S. PATENT DOCUMENTS

| | | | | |
|---|---|---|---|---|
| 6,302,014 | B1 * | 10/2001 | Kuan | A47J 43/1018 241/169.1 |
| D747,916 | S * | 1/2016 | Wong | D7/381 |
| 9,333,659 | B2 * | 5/2016 | Schillheim | A47J 43/0705 |
| 2012/0198980 | A1 * | 8/2012 | Bagley | B26D 3/283 83/699.51 |
| 2014/0165408 | A1 | 6/2014 | Schillheim | |

OTHER PUBLICATIONS

Search Report issued Apr. 21, 2016 by the UK IPO for UK Application No. 1506447.0. 3 pp.
Paderno World Cuisine Spiral Vegetable Slicer, "Tri-Blade Spiral Vegetable Slicer," posted on Nov. 15, 2013, 2 pages.

* cited by examiner

FOOD SLICING APPARATUS

FIELD

The present disclosure is directed to systems and methods of cutting and slicing food items.

BACKGROUND

Various devices are available for cutting food items into different shapes. For example, there are food slicers that can receive food items and, upon rotation of the food item, cause the food item to be cut into a number of different pieces or strands. However, many of the available devices have various shortcomings. For example, conventional devices can be difficult to use, clean, and/or replace parts. In addition, many devices are limited in the manner in which they can cut food items and altering those devices to change the type of cutting provided can be difficult or time consuming. Accordingly, an improved cutting device is desirable.

SUMMARY

In one embodiment, a slicing apparatus for creating spiral cuts of food items is provided. The apparatus includes a base with an upper surface and a lower surface, with the lower surface being generally flat and configured to rest on a horizontal surface. The apparatus also includes a food carriage that is laterally moveable along the upper surface of the base, with the food carriage being movable relative to the base from a first position to a second position. The apparatus also includes a first engaging member extending vertically from the food carriage and configured to engage with a food item and a first handle coupled to the first engaging member. The first handle is rotatable to cause the first engaging member to rotate. The apparatus includes a cutting section extending vertically from the base, with the cutting section including a first cutting area and a second cutting area. The first and second cutting areas are advantageously oriented at an acute angle relative to one another.

In some embodiments, the first and second cutting areas are at an angle of between 30 and 40 degrees relative to one another. The first cutting area can include a first blade that is generally oriented at an angle of 20 degrees or less relative to a plane defined by the cutting section, and the second cutting area can include a plurality of blades that extend generally perpendicularly from the plane of the cutting section.

In some embodiments, a second engaging member can be provided that extends perpendicular from a plane of the cutting section towards the first engaging member, so that the first and second engaging members define an axis of rotation of the food item. In other embodiments, each of the first and second cutting areas can be at an angle of less than 25 degrees relative to a vertical axis passing through the second engaging member.

In other embodiments, the apparatus can include a blade tool that has a plurality of different cutting faces. The blade tool can be rotatable so that each of the plurality of cutting faces can be oriented to define the second cutting area. In some embodiments, at least one of the plurality of cutting faces does not have any blades and the spacing of blades on at least one of the plurality of cutting faces can be different from the spacing of blades on another of the plurality of cutting faces. A cover can also be provided and coupled to a rear wall of the cutting section to at least partially surround an exposed cutting face of the blade tool.

In some embodiments, a selection member can be provided that is moveable to adjust the orientation of the cutting faces of the blade tool. The adjustment can be achieved by a gearing system coupled to the blade tool and the selection member, with the selection member being rotatable to change the orientation of the blade tool via the gearing system. The selection member can include a knob that extends from a side wall in the cutting section. The knob can be biased in an unengaged position with the gearing system.

In some embodiments, one or more suction members can be provided on the bottom surface of the base. The suction members can be configured to restrict relative movement between the base and the horizontal surface.

In other embodiments, a stop member can be provided that is moveable between a first position that doesn't restrict lateral movement of the food carriage and a second position that restricts lateral movement of the food carriage.

In another embodiment, a slicing apparatus for creating spiral cuts of food items can include a base, food carriage, first and second engaging members that engage the food item, and a cutting section comprising a straight blade and an adjustable blade tool with a plurality of cutting faces. The straight blade and blade tool can be arranged at an angle relative to each other, and each of the straight blade and blade tool can be oriented at an angle of less than 25 degrees relative to a vertical axis passing through the second engaging member.

The blade tool can include a plurality of different cutting faces and be rotatable so that each of the plurality of cutting faces can be oriented to face the first engagement member to define an operational cutting area. In some embodiments, at least one of the plurality of cutting faces does not have any blades and/or the spacing of blades on at least one of the plurality of cutting faces is different from the spacing of blades on another of the plurality of cutting faces.

A selection member can be moveable to adjust the orientation of the cutting faces of the blade tool and a gearing system can be coupled to the blade tool and the selection member. The selection member can be rotatable to change the orientation of the blade tool via the gearing system. The selection member can include a knob that extends from a side wall in the cutting section and the knob is biased in an unengaged position with the gearing system. In some embodiments, one or more suction members on the bottom surface of the base can be used to restrict relative movement between the base and the horizontal surface.

In another embodiment, a method of slicing a food item into spiral-shaped portions is provided. The method can include positioning the food item in a horizontal orientation and engaging the food item with a first engaging member of a slicing apparatus, moving the food carriage horizontally relative to a base to engage with a cutting section extending vertically from the base, rotating the first engaging member to slice the food item with a first cutting area comprising a plurality of blades extending generally perpendicular from the cutting section, and rotating the first engaging member to cut the sliced portions of the food item with a second cutting area. The first and second cutting areas can be arranged at an angle relative to each other of between 20 and 50 degrees. Alternatively, the first and second cutting areas can be arranged at an angle relative to each other of between 30 and 40 degrees.

In some embodiments, the method can include engaging the food item with a second engaging member of the slicing apparatus, with the second engaging member extending horizontally from the cutting section, and each of the first and second cutting areas can be at an angle of less than 25 degrees relative to a vertical axis passing through the second engaging member.

In other embodiments, the method can include securing a lower surface of base to a horizontal surface by creating a suction force between the lower surface of the base and the horizontal surface, and/or engaging the food item with a second engaging member that extends perpendicular from a plane of the cutting section to define an axis of rotation of the food item.

Other steps can include adjusting a cutting face of the first cutting area by rotating a blade tool comprising a plurality of different cutting faces. In this manner, different cutting faces can be used, with the spacing of blades on at least one of the plurality of cutting faces being different from the spacing of blades on another of the plurality of cutting faces. The adjustment of the blade tool can include engaging a knob with a gearing system coupled to the blade tool and rotating the knob to cause the orientation of the blade tool to change.

In some embodiments, the device can be safely stored by rotating the knob to cause the blade tool to move into an orientation with a cutting face that has no blades in the exposed orientation and adjusting a stop member to restrict relative movement between the food carriage and the base.

DETAILED DESCRIPTION

For purposes of this description, certain aspects, advantages, and novel features of the embodiments of this disclosure are described herein. The disclosed methods, apparatuses, and systems should not be construed as limiting in any way. Instead, the present disclosure is directed toward all novel and nonobvious features and aspects of the various disclosed embodiments, alone and in various combinations and sub-combinations with one another. The methods, apparatus, and systems are not limited to any specific aspect or feature or combination thereof, nor do the disclosed embodiments require that any one or more specific advantages be present or problems be solved.

Although the operations of some of the disclosed methods are described in a particular, sequential order for convenient presentation, it should be understood that this manner of description encompasses rearrangement, unless a particular ordering is required by specific language set forth below. For example, operations described sequentially may in some cases be rearranged or performed concurrently. Moreover, for the sake of simplicity, the attached figures may not show the various ways in which the disclosed methods can be used in conjunction with other methods. Additionally, the description sometimes uses terms like "determine" and "provide" to describe the disclosed methods. These terms are high-level abstractions of the actual operations that are performed. The actual operations that correspond to these terms may vary depending on the particular implementation and are readily discernible by one of ordinary skill in the art.

Figure 1A:
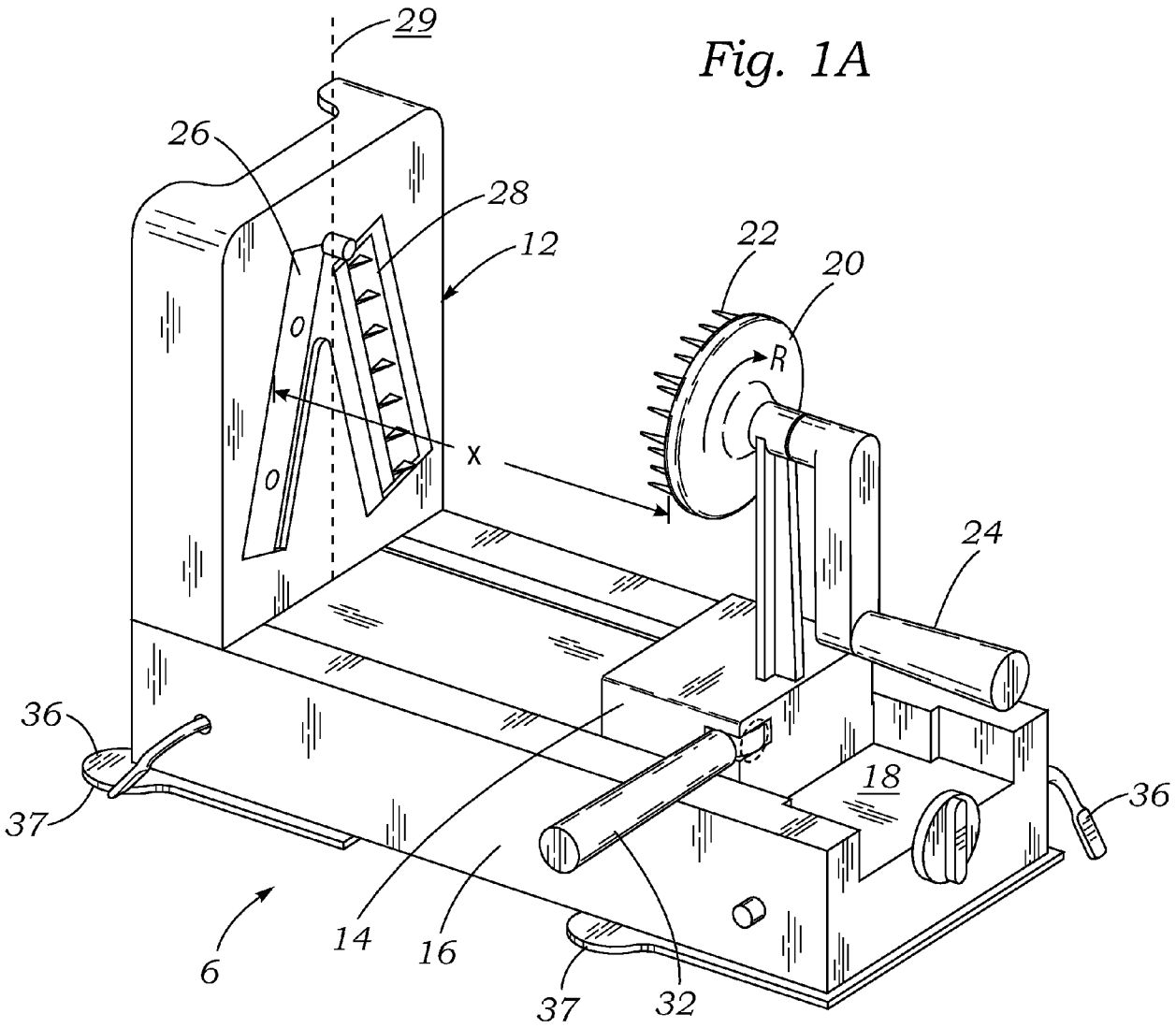
FIGS. 1A and 1B are a front perspective view of a food slicing apparatus with a food carriage in different positions.
Figure 1B:
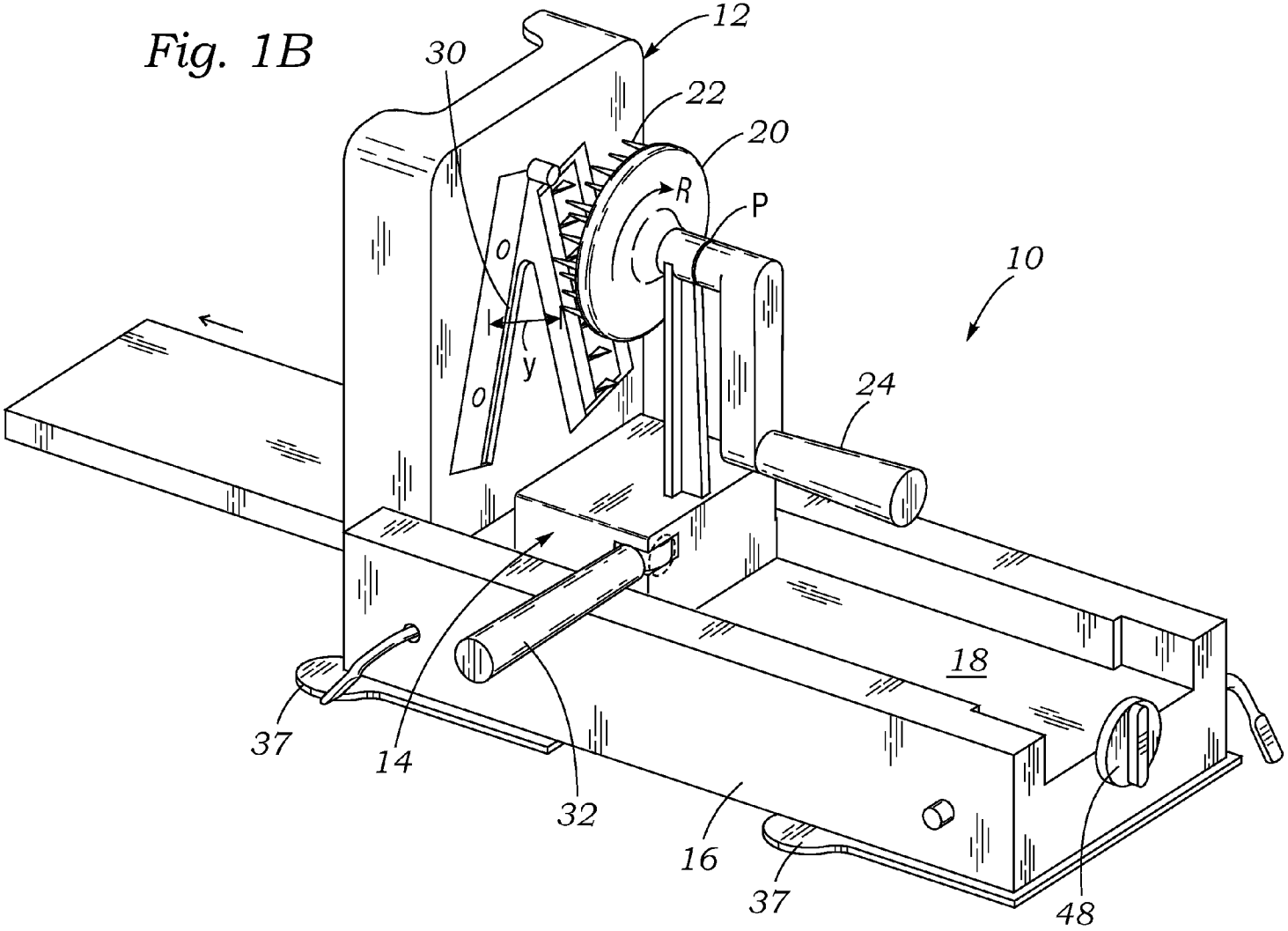

FIGS. 1A and 1B illustrates a food slicing apparatus 10 that comprises a cutting section 12 and a food carriage 14 that are moveable relative to one another to cause a food item, carried at least in part by food carriage 14, to be cut into pieces and/or strands of various shapes and sizes.

Food slicing apparatus 10 can include a base 16 upon which food carriage 14 can move relative to cutting section 12. Relative movement between base 16 and food carriage 14 can be achieved in various manners. For example, as shown in FIGS. 1A and 1B, base 16 can include a slotted portion 18 that can receive at least a portion of food carriage 14 in a slidable manner. In this way, food carriage 14 can slide horizontally along slotted portion 18 to move a food item, at least partially retained by food carriage 14, from a first distance "x" away from cutting section 12 to a second distance "y"—smaller than "x"—away from cutting section 12. FIG. 1A illustrates food carriage 14 at distance "x" and FIG. 1B illustrates food carriage 14 at distance "y."

Food carriage 14 can include a rotatable member 20 that can contact a food item and cause rotation of the food item. Rotatable member 20 can comprise one or more food-retaining portions 22 that function to secure the food item to rotatable member 20. Such food-retaining portions 22 can include, for example, one or more pointed protrusions that engage with the food member—either in a piercing manner or a non-piercing manner—to restrict relative movement of the food item and rotatable member 20. In addition, rotatable member 20 can have a handle or gripping member 24, which a user can grasp to impart the rotating motion of rotatable member 20. As shown in FIG. 1A, for example, handle 24 (i.e., a "turning handle") can be rotate about a pivot point P on food carriage 14, causing a food item engaged with food-retaining portions 22 to rotate in the direction "R," which is the same direction as the rotation of handle 24. Although R is depicted as clockwise rotation in FIGS. 1A and 1B, it should be understood that, at least in some embodiments, handle 24 (and engaged food item engaged with food-retaining portions 22) can turn in either a clockwise or counter-clockwise direction.

Figure 2:
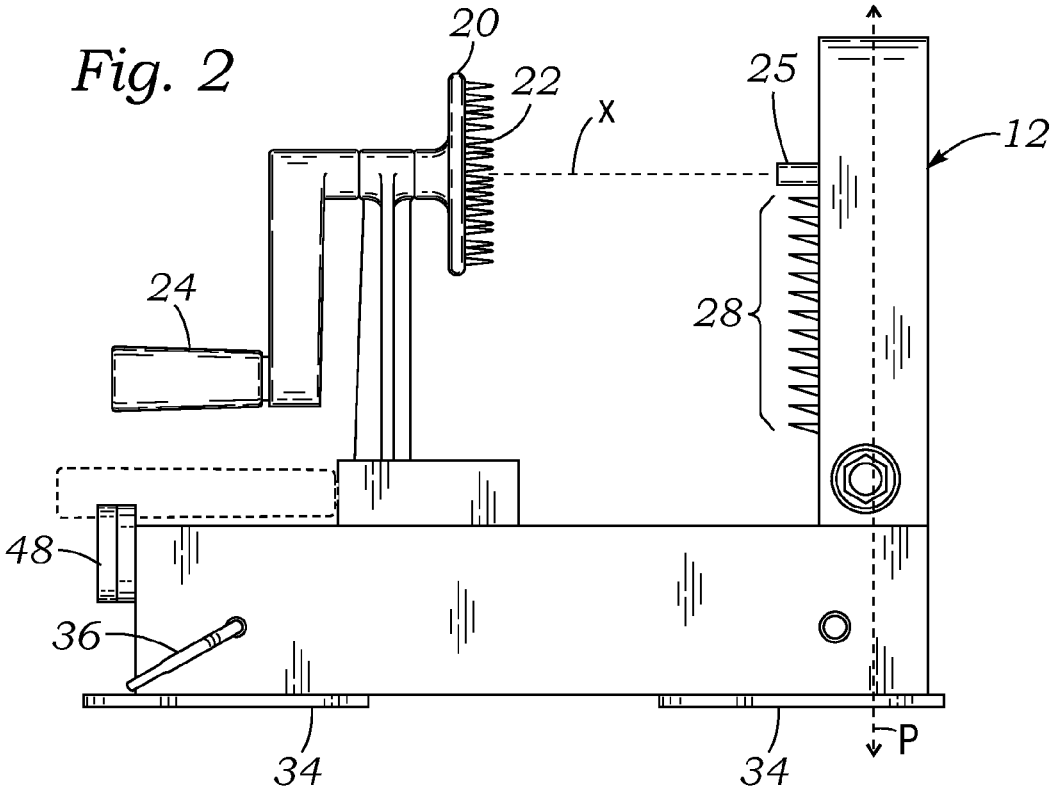
FIG. 2 is a left side view of the food slicing apparatus of FIG. 1.

Cutting section 12 extends from base 16 so that one or more blades are positioned to contact a food item engaged with food-retaining portions 22 of rotatable member 20. As shown in FIG. 2, cutting section 12 can extend vertically from base 16. Although cutting section 22 preferably extends in a generally perpendicular manner from base 16, other orientations can be used if desired.

To facilitate a spiral cut of a food item, the food item can be engaged with food slicing apparatus 10 at both ends of the food item. At one end the food item engages with the rotatable member 20 (e.g., food-retaining portions 22), and, at the other end, the food item can engage with the cutting section 22. In some embodiments, a projecting member 25 (e.g., a "coring blade" in some embodiments) extends from cutting section 22 to secure the other end of the food item during cutting. Projecting member 25 can engage with the food item in various manners (e.g., piercing, non-piercing)

so long as it serves the function of generally fixing the vertical location of that end so that the food item can rotate about an axis "X" defined by the two points of engagement. Projecting member 25 preferably can receive food items that are both small in diameter, such as carrots and red radishes, and large in diameter, such as rutabaga. In some embodiments, projecting member 25 comprises a hollow cylindrical member with a relative thin wall section which can pierce a food item to maintain engagement of the food item on projecting member 25 during the cutting process.

The number and type of blades that are provided on cutting section can vary. In one embodiment, cutting section 12 includes a first cutting area 26 and a second cutting area 28. First cutting area 26 has a blade that is generally parallel to a plane defined by cutting section 22 or at a relatively small angle relative to that plane (i.e., about 20 degrees or less, or more preferably less than about 10 degrees). The blade of cutting area 26 can be a generally straight blade. In this manner, the blade of first cutting area 26 can slice a food item with a longitudinal axis in a plane (i.e., an axis generally similar to that defined by the direction "x" when the food item is positioned on slicing apparatus 10) in a cutting direction that is generally perpendicular to the longitudinal axis of the food item. An opening 30 is provided along the length of the blade to allow the cut portion of the food item to pass through cutting section 12. Although FIG. 1A shows a single blade of first cutting area 26, it should be understood that one or more blades could be used.

Figure 3:
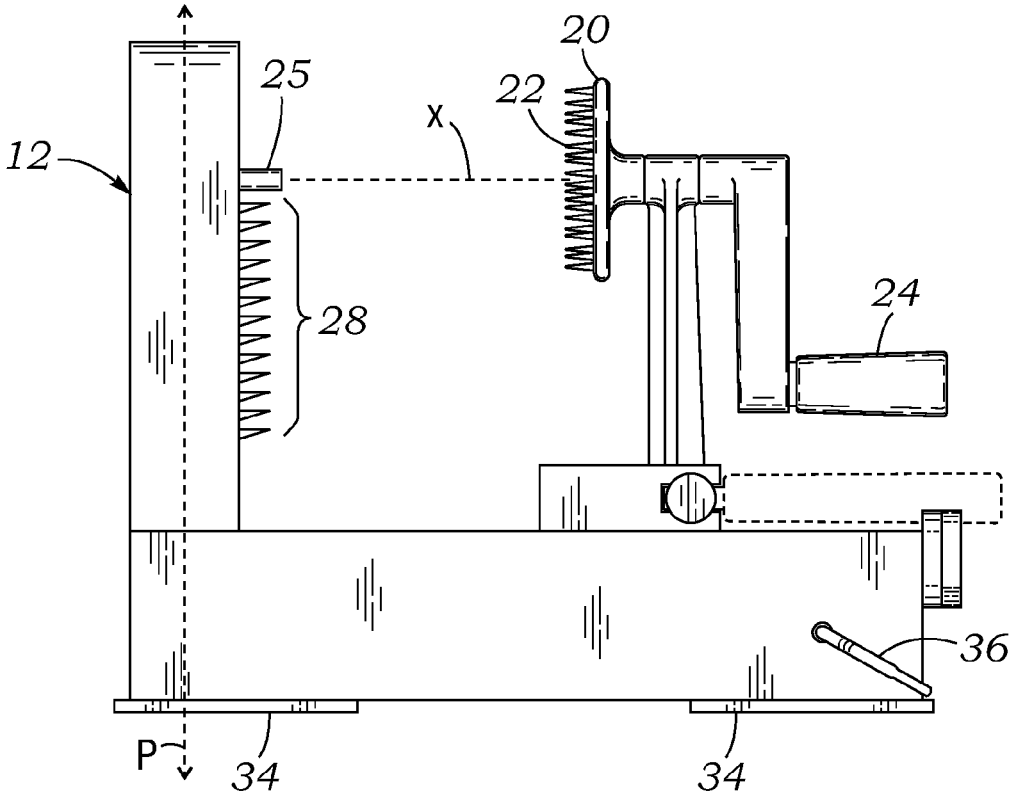
FIG. 3 is a right side view of the food slicing apparatus of FIG. 1.

Second cutting area 28 has a plurality of blades that extend in a generally perpendicular direction from the plane "P" defined by cutting section 12. As shown in FIGS. 2 and 3, for example, the plurality of blades extend outward from cutting section 12 to provide spaced apart cutting blades that can slide a food item into different sections. In some embodiments, the blades of section cutting area 28 are equally spaced apart (i.e., the spacing between adjacent blades is generally the same) to provide similarly sized slices of the food item.

Figure 7:
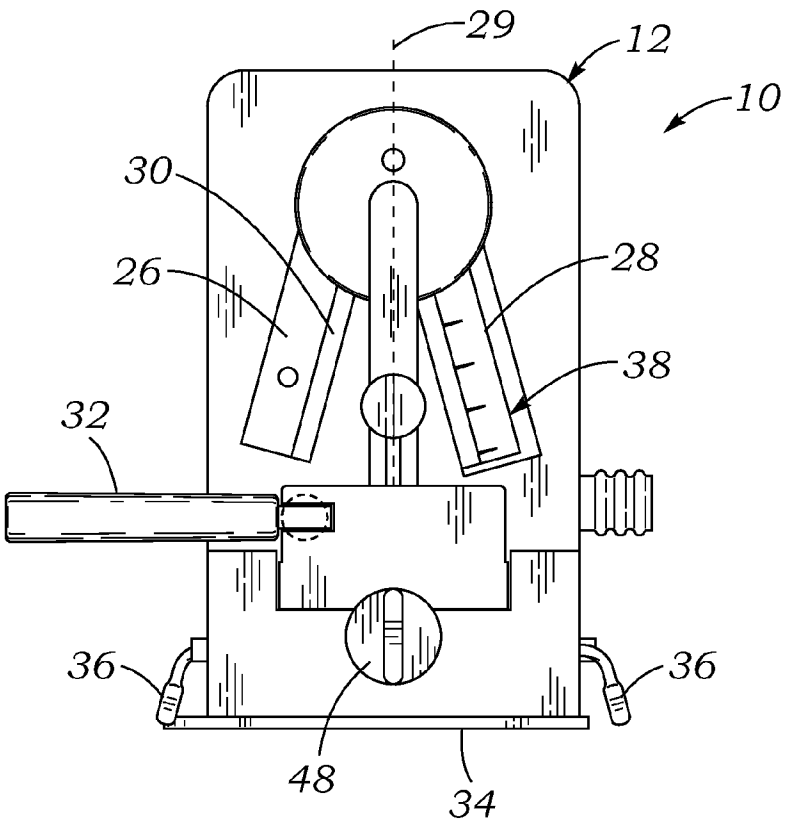
FIG. 7 is a front end view of the food slicing apparatus of FIG. 1.
Figure 6:
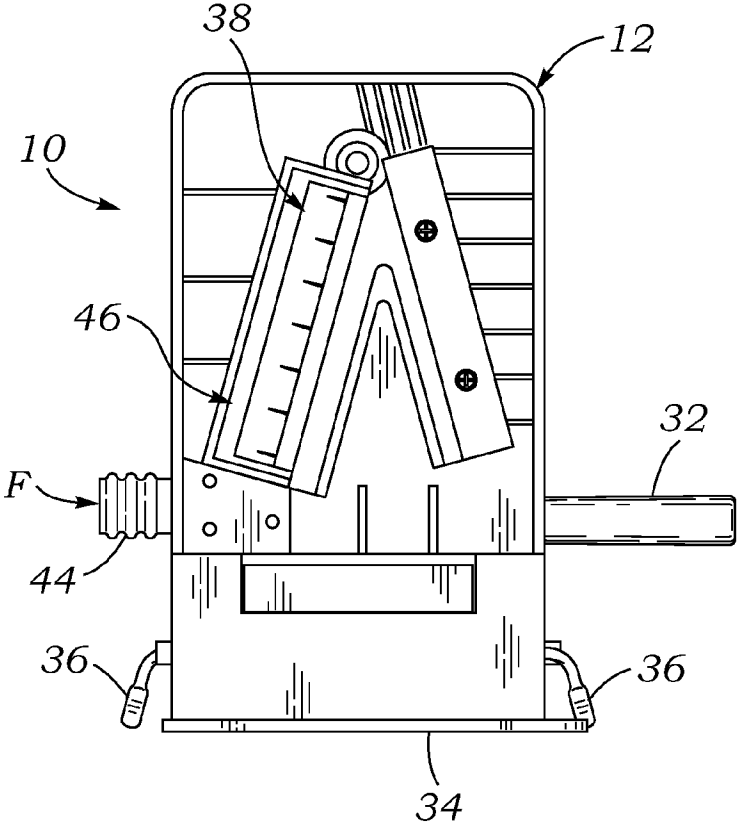
FIG. 6 is a back end view of the food slicing apparatus of FIG. 1.

FIGS. 6 and 7 illustrate in more detail the arrangement of first and second cutting areas 26, 28 to one another. As shown in FIGS. 1A and 7, in one embodiment, the two cutting areas are positioned such that an angle between them is acute. The angle formed between the two cutting areas can be between about 20 and 50 degrees, in one embodiment, the angle can be between 30 and 40 degrees, such as about 35 degrees. In addition, both cutting areas can be positioned at an angle to an axis 29 extending perpendicularly from the plane of the base 16. As shown in FIG. 1A, the angle between each cutting area and axis 29 can be about the same, with each angle being less than about 25 degrees, or more preferably less than about 20 degrees relative to axis 29.

As shown in FIGS. 1A and 7, the blades of cutting areas 26, 28 form an angle relative to axis 29 (a line normal to a plane defined by base 16). In this manner, the respective blades can function to achieve a slicing action (i.e., compared to a chopping action) when a food item is rotated into the blades of these sections. This can create more uniform cuts and reduce wear on the blades of the system. In one embodiment, both blades are positioned at the same angle relative to axis 29. The angle formed by each respective blade with axis 29 can vary between about 10 and 25 degrees, and more preferably between about 12.5 and 17.5 degrees.

In one embodiment, the angle formed by the blade of cutting area 26 and axis 29 is at least 10 degrees to provide a desired slicing action. In other embodiments, the angle can be at least 12.5 degrees, at least 15 degrees, or at least 17.5 degrees.

When a food item is urged toward the cutting section 12, first and second cutting areas 26, 28 cooperatively cut that food item into several spiral sections. For example, in operation, the following actions can be performed to cut a food item:

- A food item can be secured between rotatable member 20 and cutting section 12 (e.g., at projecting member 25).
- Rotatable member 20 can be rotated (e.g., by rotating handle 24 in a clockwise or counter-clockwise direction), causing the food item to rotate in the same direction.
- The food item can be urged toward the cutting section 12 by pushing food carriage 14 towards cutting section 12. Food carriage 14 can be pushed in the direction of cutting section 12 by simply exerting pressure on handle 24 while rotating handle 24. Alternatively, a second handle 32 can be used to push food carriage 14 in the desired direction while, at the same time, rotating handle 24. (FIG. 1A shows food carriage 14 in a first position, FIG. 1B shows food carriage 14 in a second position, closer to the cutting section than the first.)
- As the food item comes into contact with the plurality of blades of second cutting section 28, the food item is cut into sections.
- After contacting second cutting section 28, that portion of the food item comes into contact with the blade or blades of first cutting section 26, which cuts the food item in slices.
- The sliced and sectioned food item passes through opening 30, with the resulting cuts of the food item being generally spiral in shape.

In this manner, food items of various shapes and sizes can be cut into spiral cut sections by the engagement of the food item with cutting section 12 and the rotational movement of the food item by rotatable member 20.

Figure 4:
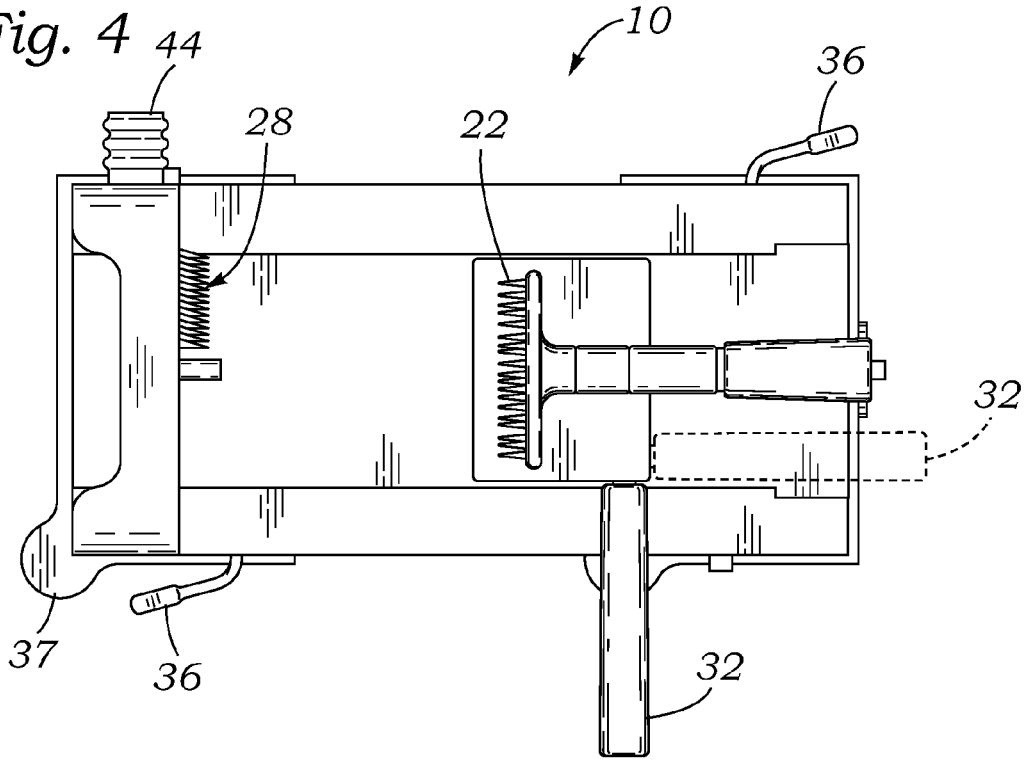
FIG. 4 is a top view of the food slicing apparatus of FIG. 1.

In some embodiments, second handle 32 can move between different positions to facilitate operation and storage of slicing apparatus 10. For example, as shown in FIG. 4, handle 32 can move between a first position that is generally perpendicular to a length of the slicing apparatus 10 to facilitate moving the food item towards cutting section 12 and a second position that is generally parallel to the length of the slicing apparatus 10 to facilitate storage of the apparatus by providing a narrower overall profile. It should be understood, however, that either position could be used for storage or movement of the food item depending on personal preferences of the user.

Figure 5:
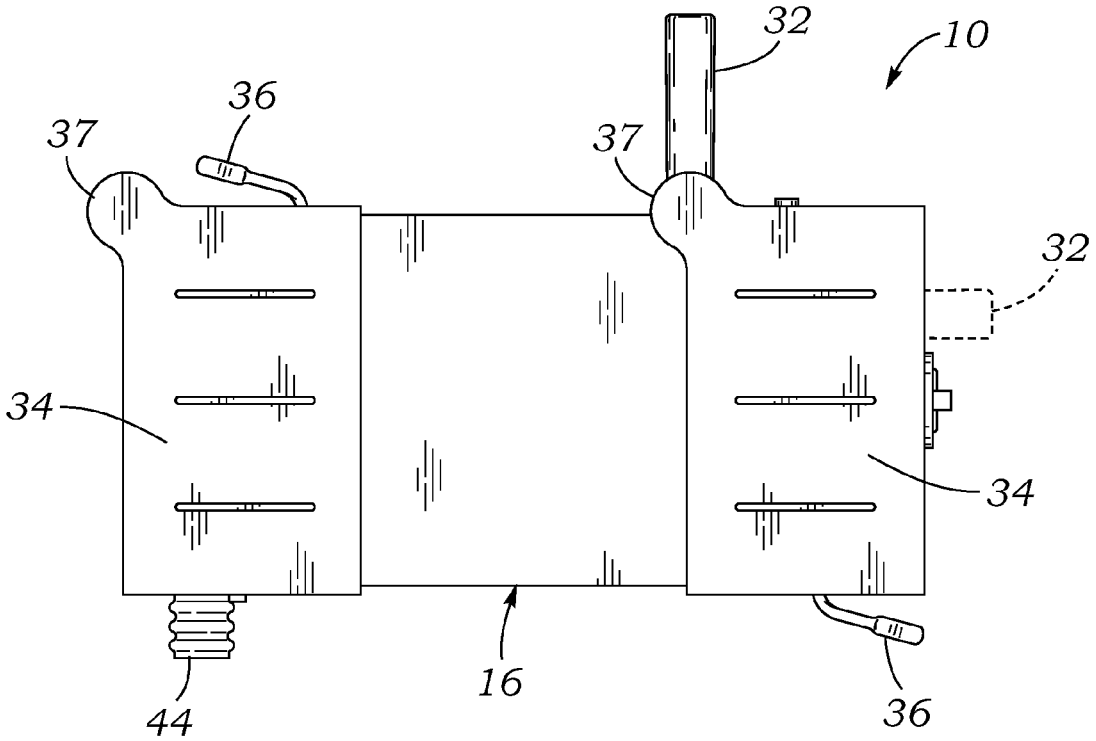
FIG. 5 is a bottom view of the food slicing apparatus of FIG. 1.

To facilitate operation of the cutting tool, one or more suction members 34 can be provided on the bottom of base 16. Suction members 34 can comprise a suction-engagement member 36 which creates a seal by creating at least a partial vacuum between the surface of suction members 34 and the surface on which suction members 34 rests. Preferably, suction members 34 extend across a large portion of base 16 to provide a strong gripping force. In the embodiment shown in FIG. 5, both suction members 34 generally extend the width of the base and are positioned at both ends of the apparatus for improved suction strength. To release the suction force, suction-engagement members 36 can be released (i.e., moved to an unclamped position) and an upward force can be applied to one or more tab members 37 to disengage the suction force.

The suction members securing slicing apparatus 10 to a horizontal surface (e.g., a countertop), which provides increased leverage and ease of cutting. The dual vacuum base and/or larger vacuum surface can help facilitate cutting by providing a user with greater leverage. This can be particularly helpful when cutting larger or tougher food items.

The type and shape of spiral-cut food items is determined by the arrangement and type of blades. In one embodiment, second cutting area 28 has a plurality of blade selections possible. As shown in FIG. 6, a blade tool 38 can be provided that has a plurality of blade members that can be selected for use. Blade tool 38 can include at least two different blade members that rotate to provide the second cutting areas 28 shown in FIGS. 1A and 7. In the embodiment shown in FIGS. 6-9, blade tool 38 has a plurality of different cutting faces 40A-D, with each face providing a respective cutting area 28 that can be used in connection with the cutting section 12 to adjust the type of cut achieved by slicing apparatus 10.

Each of the second cutting areas 28 provided on blade tool 38 can be different. For example, each of the second cutting areas 28 of blade tool 38 can have different blades or different blade spacing to provide for different width spiral cuts. For example, the spacing of the multiple blades can vary from about ⅛" to ½" spacing between adjacent blades on a cutting face. In one embodiment, for example, blade tool 38 can have a second cutting area 28 with a ⅛" spacing (e.g., 40A), one with a ¼" spacing (e.g., 40B), one with ⅓" (e.g., 40C) and one with a ½" spacing (e.g., 40D) between blades along a length of respective cutting faces. These different blades and/or spacing result in different types of cuts, such as spaghetti and angel hair pasta cuts, linguine noodle cuts, fettuccine noodle cuts, and wide, ribbon-type noodle cuts.

In addition, if desired, at least one of the faces of blade tool 38, can have no blades at the second cutting area 28. If there are no blades in second cutting area 28, then only the first cutting area 26 will engage the food item, which would result in a single cut of a wide ribbon of the food item. In addition, for safe handling, if there is at least one face without blades, slicing apparatus can be stored with a non-bladed face in the operational position (i.e., the position facing food carriage 14).

Figures 8, 9A, 9B:
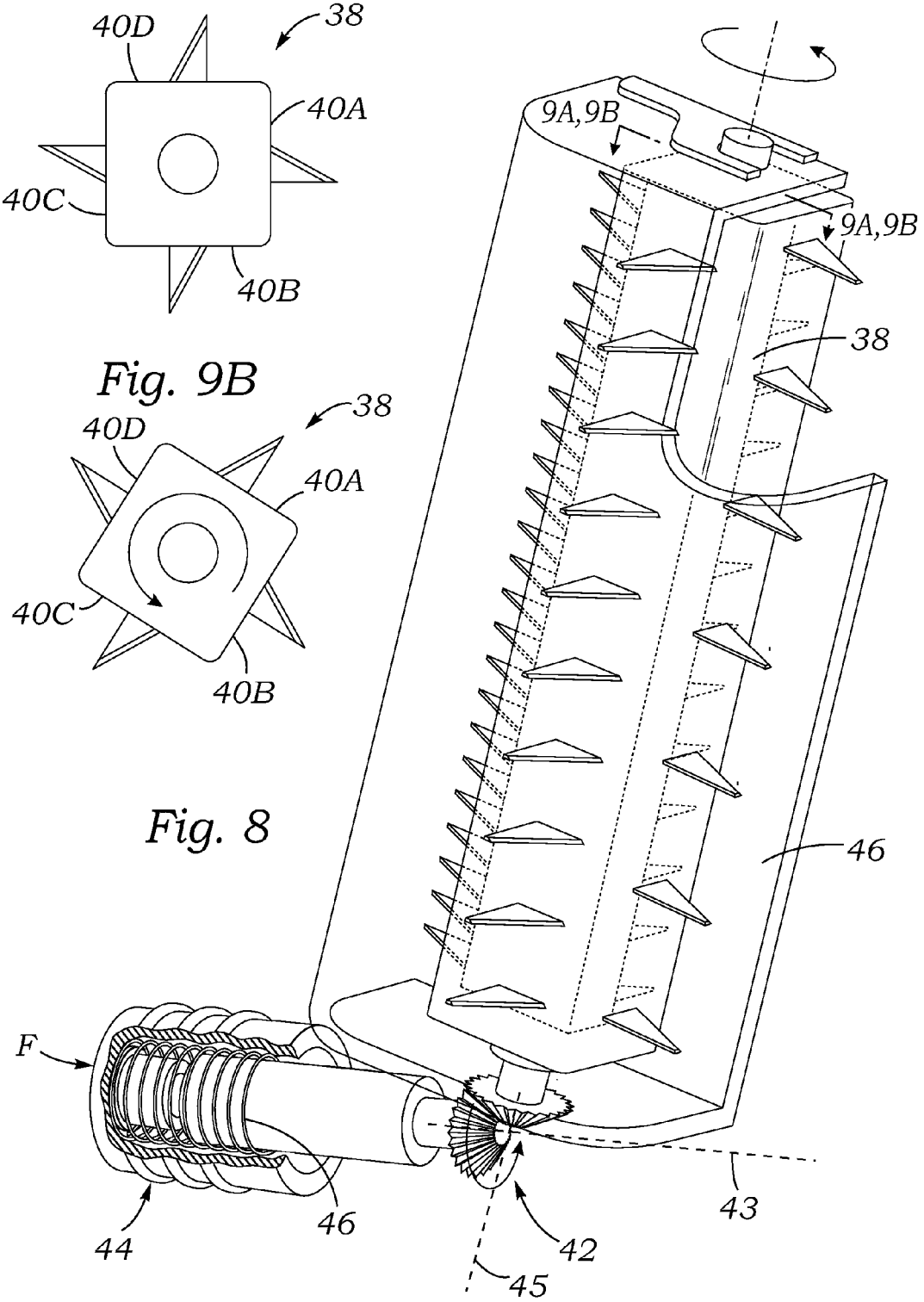
FIG. 8 is an isolated view of a blade tool with multiple cutting faces and exemplary operational components of the same.
FIGS. 9A and 9B show cross-sectional views taken along lines 9A-9A and 9B-9B, respectively.

Changing blades of second cutting areas 28 can be achieved by rotating blade tool 38. As shown in FIG. 8, blade tool 38 can be coupled to a gearing system 42. A knob 44 extends from cutting section 12. Rotation of knob 44 causes gearing system 42 to change the orientation of 38 blade tool. Gearing system 42 can comprise a pair of beveled gears that mesh to allow rotational movement about a first axis 43 (caused by rotation of knob 44) to impart rotational movement about a second axis 45 (causing rotation of blade tool 38). In the embodiment shown in FIG. 8, the angle between the axis about which blade member 38 rotates and first axis 43 is between about 100 and 120 degrees, and more preferably between about 105 and 115 degrees, such as about 110 degrees. In one embodiment, the inside angle between the gear on the changing knob and the gear on blade tool 38 is about 80 degrees when viewed from the back of the unit.

As blade tool 38 rotates, different cutting faces 40A-D move into the operational position shown in FIG. 1A. As discussed above, the shape of the cut of the food item can be varied by rotating knob 44 and changing the operation blade of cutting area 38.

To prevent unintentional movement of knob 44, and unintentional movement of blade tool 38, knob 44 can be biased in an unengaged position with the gearing system. In this manner, to engage knob 44 with gearing system 42, a lateral force "F" must be applied to knob 44 to overcome a biasing member 46 (e.g., a spring member). By pushing on knob 44, biasing member 46 is overcome, and knob 44 engages with gearing system 42, allowing rotation of knob 44 to rotate blade tool 38. Each cutting face of blade tool 38 can correspond to indicia on knob 44 (or indicia on slicing apparatus 10 adjacent knob 44) that indicate correspondence between knob positions and operational cutting face positions of blade tool 38.

In some embodiments, a safety cover 46 can be provided on the back of slicing apparatus 10 to ensure safe handling of slicing apparatus by preventing contact with a blades in non-operational positions. Safety cover 46 can be removable for cleaning or to otherwise provide access to blade tool 38.

A stop member 48 can be provided on base 16 to facilitate safe storage of slicing apparatus 10 by restricting lateral movement of food carriage 14 beyond stop member 48. When in use, stop member 48 can be rotated (as shown by arrow 50) to a first position in which it does not restrict movement of food carriage 14. When not in use, stop member 48 can be rotated (to the position show in FIG. 7) so that food carriage 14 cannot slide out of slotted portion 18.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. I therefore claim as my invention all that comes within the scope and spirit of these claims.

We claim:

1. A slicing apparatus for creating spiral cuts of food items, comprising:

a base with an upper surface and a lower surface, the lower surface being generally flat and configured to rest on a horizontal surface;

a food carriage laterally moveable along the upper surface of the base, the food carriage being movable relative to the base from a first position to a second position;

a rotatable member spaced vertically from the food carriage and configured to engage with a food item;

a first handle coupled to the rotatable member, the first handle being rotatable to cause the rotatable member to rotate; and a cutting section extending vertically from the base, the cutting section comprising a first cutting area and a second cutting area, the first and second cutting areas being oriented at an acute angle relative to one another;

a blade tool that has a plurality of different cutting faces and the blade tool is rotatable about a first axis of rotation so that each of the plurality of cutting faces can be oriented to define the second cutting area;

wherein the spacing of blades on at least one of the plurality of cutting faces is different from the spacing of blades on another of the plurality of cutting faces;

a rotatable selection member for adjusting the orientation of the blade tool and having a second axis of rotation different than the first axis of rotation;

a gearing system coupled to the selection member and blade tool to convert rotation of the selection member to rotation of the blade tool;

a biasing member cooperative with the selection member to bias the selection member to an unengaged position with the gearing system, such that the application of a force to the selection member overcomes the biasing member to engage the gearing system and rotate the blade tool.

2. The slicing apparatus of claim 1, wherein the first and second cutting areas are at an angle of between 30 and 40 degrees relative to one another.

3. The slicing apparatus of claim 1, wherein the first cutting area comprises a first blade that is generally oriented at an angle of 20 degrees or less relative to a plane defined by the cutting section, and the second cutting area comprises a plurality of blades that extend generally perpendicularly from the plane of the cutting section.

4. The slicing apparatus of claim 1, further comprising a projecting member extending perpendicular from a plane of the cutting section towards the rotatable member, the rotatable member and projecting member defining an axis of rotation of the food item.

5. The slicing apparatus of claim 4, wherein each of the first and second cutting areas is at an angle of less than 25 degrees relative to a vertical axis passing through the second engaging member.

6. The slicing apparatus of claim 1, wherein at least one of the plurality of cutting faces does not have any blades.

7. The slicing apparatus of claim 1, further comprising a cover coupled to a rear wall of the cutting section to at least partially surround an exposed cutting face of the blade tool.

8. The slicing apparatus of claim 1, wherein the selection member comprises a knob that extends from a side wall in the cutting section.

9. The slicing apparatus of claim 1, further comprising one or more suction members on the bottom surface of the base, the suction members being configured to restrict relative movement between the base and the horizontal surface.

10. The slicing apparatus of claim 1, further comprising a stop member that is moveable between a first position that doesn't restrict lateral movement of the food carriage and a second position that restricts lateral movement of the food carriage.

11. A slicing apparatus for creating spiral cuts of food items, comprising:

a base with an upper surface and a lower surface, the lower surface being generally flat and configured to rest on a horizontal surface;

a food carriage laterally moveable along the upper surface of the base, the food carriage being movable relative to the base from a first position to a second position;

a rotatable member spaced vertically from the food carriage and configured to engage with a food item;

a cutting section;

a projecting member extending perpendicular from a plane of the cutting section towards the rotatable member, the rotatable member and projecting member defining an axis of rotation of the food item;

a first handle coupled to the rotatable member, the first handle being rotatable to cause the rotatable member to rotate; and the cutting section comprising a straight blade and an adjustable rotatable blade tool with a plurality of cutting faces, the straight blade and blade tool being arranged at an angle relative to each other, and each of the straight blade and blade tool being oriented at an angle of less than 25 degrees relative to a vertical axis passing through the projecting member;

a rotatable selection member having a different axis of rotation than the blade tool, the selection member being rotatable to adjust the orientation of the cutting faces of the blade tool; and a gearing system coupled to the blade tool and selection member, the selection member being rotatable to change the orientation of the blade tool via the gearing system;

a biasing member cooperative with the selection member to bias the selection member to an unengaged position with the gearing system, such that the application of a force to the selection member overcomes the biasing member to engage the gearing system and rotate the blade tool.

12. The slicing apparatus of claim 11, wherein at least one of the plurality of cutting faces does not have any blades.

13. The slicing apparatus of claim 11, wherein the spacing of blades on at least one of the plurality of cutting faces is different from the spacing of blades on another of the plurality of cutting faces.

14. The slicing apparatus of claim 11, wherein the selection member comprises a knob that extends from a side wall in the cutting section.

15. The slicing apparatus of claim 11, further comprising one or more suction members on the bottom surface of the base, the suction members being configured to restrict relative movement between the base and the horizontal surface.

16. The slicing apparatus of claim 11, further comprising a stop member that is moveable between a first position that doesn't restrict lateral movement of the food carriage and a second position that restricts lateral movement of the food carriage.

17. A method of slicing a food item into spiral-shaped portions, the method comprising:

providing the slicing apparatus of claim 1;

positioning the food item in the horizontal orientation and engaging the food item with the rotatable member of the slicing apparatus, the rotatable member extending vertically from the food carriage;

moving the food carriage horizontally relative to the base to engage with the cutting section extending vertically from the base;

rotating the rotatable member to slice the food item with the first cutting area comprising the plurality of blades extending generally perpendicular from the cutting section; and adjusting a cutting face of the first cutting area by using the gearing system to rotate the blade tool comprising the plurality of different cutting faces, wherein the adjusting step includes applying a force to the selection member biased in the unengaged position to engage the gearing system and rotate the blade tool;

wherein the spacing of blades on at least one of the plurality of cutting faces is different from the spacing of blades on another of the plurality of cutting faces, rotating the rotatable member to cut the sliced portions of the food item with the second cutting area, the second cutting area comprising a generally straight blade; wherein the first and second cutting areas are arranged at an angle relative to each other of between 20 and 50 degrees.

18. The method of claim 17, wherein the first and second cutting areas are arranged at an angle relative to each other of between 30 and 40 degrees.

19. The method of claim 17, further comprising: engaging the food item with the projecting member of the slicing apparatus, the projecting member extending horizontally from the cutting section, wherein each of the first and second cutting areas is at an angle of less than 25 degrees relative to a vertical axis passing through the second engaging member.

20. The method of claim 17, further comprising securing the lower surface of base to a horizontal surface by creating a suction force between the lower surface of the base and the horizontal surface.

21. The method of claim 17, further comprising engaging the food item with the projecting member that extends perpendicular from a plane of the cutting section to define an axis of rotation of the food item.

22. The method of claim 17, further comprising: rotating the selection member to cause the blade tool to move into an orientation with a cutting face that has no blades in the exposed orientation; and adjusting the stop member to restrict relative movement between the food carriage and the base.

* * * * *